US007241237B2

(12) United States Patent
Iggulden

(10) Patent No.: US 7,241,237 B2
(45) Date of Patent: Jul. 10, 2007

(54) METHOD AND APPARATUS FOR TEMPORARILY MARKING A POINT OF CONTACT

(76) Inventor: Jerry Iggulden, 12400 Wilshire Blvd, Seventh Floor, Los Angeles, CA (US) 90025

( * ) Notice: Subject to any disclaimer, the term of this patent is extended or adjusted under 35 U.S.C. 154(b) by 29 days.

(21) Appl. No.: 10/500,779

(22) PCT Filed: Jan. 22, 2003

(86) PCT No.: PCT/US03/01951

§ 371 (c)(1),
(2), (4) Date: Sep. 21, 2004

(87) PCT Pub. No.: WO03/061770

PCT Pub. Date: Jul. 31, 2003

(65) Prior Publication Data

US 2005/0043126 A1 Feb. 24, 2005

Related U.S. Application Data

(63) Continuation of application No. 10/055,532, filed on Jan. 22, 2002, now Pat. No. 6,726,584.

(51) Int. Cl.
*A63B 39/06* (2006.01)
*A63B 69/38* (2006.01)

(52) U.S. Cl. ..... 473/606; 473/577

(58) Field of Classification Search ..... 473/606, 473/577, 570, 467, 593, 594, 387, 237; 106/31.01, 106/31.04

See application file for complete search history.

(56) References Cited

U.S. PATENT DOCUMENTS 3,883,860 A * 5/1975 von Kohorn ..... 473/467
3,948,173 A * 4/1976 Barasch ..... 101/333
4,065,126 A 12/1977 Mantz
4,109,911 A 8/1978 Van Auken
4,538,811 A 9/1985 Wigoda
4,596,392 A 6/1986 Walker
4,637,616 A 1/1987 Whiting
4,718,670 A 1/1988 Gray
4,739,989 A 4/1988 Prinz et al.
4,830,370 A 5/1989 Schlesinger
4,886,275 A 12/1989 Walker
4,995,613 A 2/1991 Walker
5,232,769 A * 8/1993 Yamato et al. ..... 428/320.2
5,394,824 A 3/1995 Johnson, Jr.
5,551,688 A 9/1996 Miller
5,823,891 A 10/1998 Winskowicz
6,066,689 A 5/2000 Columbus et al.
6,145,441 A 11/2000 Woodall et al.
6,309,315 B1 * 10/2001 Adams et al. ..... 473/387
6,659,775 B1 * 12/2003 Moy ..... 473/387
6,726,584 B2 4/2004 Iggulden

FOREIGN PATENT DOCUMENTS

DE 3904458 A1 8/1990

*Primary Examiner*—Steven Wong
(74) *Attorney, Agent, or Firm*—Blakely, Sokoloff, Taylor & Zafman, LLP

* cited by examiner

(57) ABSTRACT

The present invention provides a game ball with a transient marking feature that may be used on any court surface. No preparation of the court surface is required. The game ball is coated with a temporary marking agent that is encapsulated or otherwise sealed against exposure to the air. When the ball contacts a surface with sufficient velocity, a small quantity of the marking agent is liberated to provide a visible mark on the surface at the point of contact. Similar to a "disappearing ink", the marking agent dissipates after being released from the microcapsules.

4 Claims, 1 Drawing Sheet

METHOD AND APPARATUS FOR TEMPORARILY MARKING A POINT OF CONTACT

This application is a continuation of U.S. Ser. No. 10/055,532, filed Jan. 22, 2002, now U.S. Pat. No. 6,726,584, issued Apr. 27, 2004.

BACKGROUND OF THE INVENTION

1. Field of the Invention

This invention relates generally to the field of indicating a point of contact between two objects. In a particular embodiment, the invention relates to a ball treated so as to leave a transient visible mark at the point of contact with a surface.

2. Background

A number of games, particularly tennis, are played on a court marked with boundary lines. During playing of the game, it is important to know when a ball lands outside of the boundary lines since this will affect the scoring of the game. In games where the ball is traveling at high speed, it is frequently difficult to visually determine if the ball has landed "in" or "out" of bounds. Line judges are typically employed in professional matches to make such determination. Their calls are important to the outcome of the game and often incite heated reaction from the players and spectators.

A number of methods and systems have been proposed for automatically determining whether a game ball, particularly a tennis ball, is "in" or "out". Many of these require specially prepared courts and/or sophisticated tracking equipment. A system described in U.S. Pat. No. 4,109,911 utilizes a ball with a chemically treated surface that provides a transient indication when it contacts a chemically treated court surface. Thus, even this system requires a specially prepared court.

SUMMARY OF THE INVENTION

The present invention provides a game ball with a transient marking feature that may be used on any court surface. No preparation of the court surface is required. The game ball is coated with a temporary marking agent that is encapsulated or otherwise sealed against exposure to the air. When the ball contacts a surface with sufficient velocity, a small quantity of the marking agent is liberated to provide a visible mark on the surface at the point of contact. Similar to a "disappearing ink", the marking agent dissipates after being released from the microcapsules.

DETAILED DESCRIPTION OF THE INVENTION

In the following description, for purposes of explanation and not limitation, specific details are set forth in order to provide a thorough understanding of the present invention.

However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
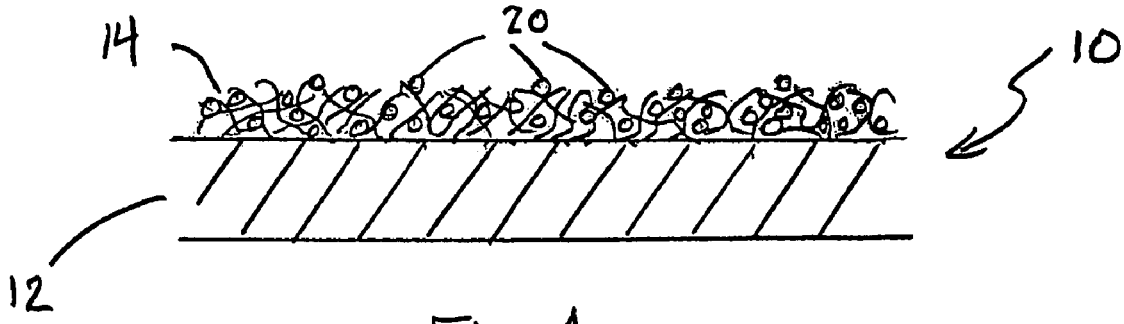
FIG. 1 is a magnified cross-sectional view of a game ball treated in accordance with a first embodiment of the present invention.

FIG. 1 is a magnified cross-sectional view of a tennis ball 10. In accordance with conventional tennis ball construction, ball 10 has a spherical rubber core 12 covered with felt 14. In one embodiment of the present invention, microcapsules 20 are dispersed within the felt. Microencapsulation is widely used as a packaging technique for a variety of volatile substances. The principles and techniques of microencapsulation are well known. Microcapsules 20 contain a marking agent functionally similar to a "disappearing ink". One such marking agent that is commonly used for "disappearing ink" is thymolphthalein, which is colorless in a neutral or acidic solution, but is blue in a basic solution. When a slightly basic solution of thymolphthalein (soluble in alcohol) is exposed to air, the carbon dioxide in the air reacts with the solution, thereby decreasing the pH of the solution and turning the thymolphthalein colorless.

Microcapsules 20 are adhered to the fibers of felt 14 with a suitable adhesive. In order to avoid "matting" of the felt, it is preferred that the microcapsules be coated with a heat- or radiation-activated adhesive. The ball 10 may then be tumbled in the coated microcapsules, which are naturally captured in the nap of the felt, and subsequently exposed to the appropriate heat or radiation to activate the adhesive.

Microcapsules 20 are preferably formed so that they will rupture only upon a substantial impact. Thus, ball 10 may be subjected to normal handling and may even be bounced by hand on pavement without rupturing the microcapsules. However, when ball 10 strikes the court surface during play, the impact is sufficient to rupture a quantity of microcapsules 20, thereby depositing the marking agent on the court surface and, in the case of thymolphthalein, leaving a temporary blue mark. It will be appreciated that a blue or other colored marking agent will generally be visible anywhere on the playing court surface. If desired, a white or yellow marking agent may be employed, which will leave a higher visibility mark away from the boundary lines of the court, but will generally not leave an easily visible mark on the boundary lines themselves.

Several types of marking agents have been considered: acid/base reactions (e.g. thymolphthalein and disappearing ink as discussed above), deliquescence (solid to liquid via moisture absorption from the air), sublimation (a solid that goes to gaseous phase without passing through a liquid phase, e.g. dry ice), the evaporation of a solid with a low vapor pressure, and color-to-colorless shift (and vice-versa) through charge-transfer chemistry.

For a variety of reasons including visibility, safety (i.e. low toxicity), and insolubility in water that is important for most microencapsulation processes, a low vapor-pressure solid is desirable as a marking agent. Candidates include norbornylene, iodaform, acenapthalene, azulene, and durene. While norbornane would seem to be a suitable candidate, its vapor pressure is too high to microencapsulate using conventional processes. Durene (1,2,4,5 tetramethylbenzene) is a waxy, white solid with an acceptable vapor pressure significantly lower than that of norbornane, yet it is still a solid that will sublimate in a small amount of time at room temperature.

One particularly attractive marking agent is a mixture of durene and toluene. The solid durene is prepared in a 40% by weight solution of toluene and is microencapsulated in the usual urea/formaldehyde solution. The shelf life of the volatile marking agent inside the microcapsule is estimated to be greater than three years. When the microcapsule is broken, the solid evaporates at a rate determined primarily by surface temperature. For the particular application of tennis balls, it is believed that the microcapsules should have diameters in the range of approximately 30-200 microns.

The color of the marking agent may be adjusted using suitable additives. If blue is desired, azulene could be mixed in. For yellow, a small amount of acenapthalene could be added, or difluorodiiodomethane, or iodaform. Materials to increase the visibility of a white marking agent may include micro-fine sodium chloride, and on the deliquescent side, calcium chloride or potassium acetate. Issues with the latter three mostly revolve around the fact that the cheapest and most robust microencapsulation processes are all done in aqueous solution, so hydrophilic and water-soluble compounds have problems being microencapsulated. The invention is not limited to using solids inside the microcapsules, although it is generally believed solids will be more visible. Some potentially suitable liquids include thymolphthalein as discussed above and oil-miscible pentanediones.

Figure 2:
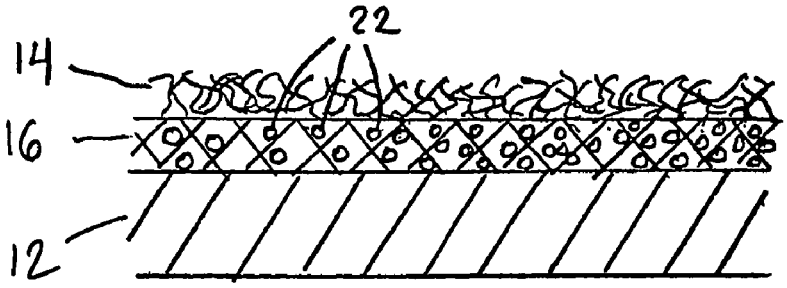
FIG. 2 is a magnified cross-sectional view of a game ball treated in accordance with another embodiment of the present invention.
Figure 3:
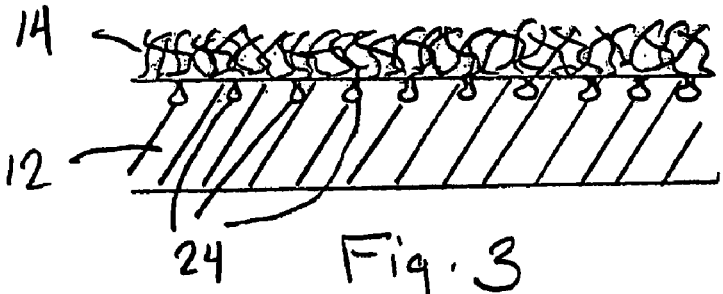
FIG. 3 is a magnified cross-sectional view of a game ball treated in accordance with yet another embodiment of the present invention.

The marking agent may be applied to ball 10 by means other than microencapsulation. For example, as shown in FIG. 2, a layer of material 16 may be interposed between the rubber core 12 and the felt 14. Material 16 incorporates microreservoirs 22, which are filled with a marking agent. Material 16 thus functions something like a sponge to retain the marking agent until it is released upon impact. In this embodiment, rubber core 12 is necessarily made somewhat smaller than a conventional tennis ball core to accommodate the additional thickness of material 16. Alternatively, as shown in FIG. 3, the rubber core 12 itself may be constructed to incorporate microreservoirs 24 containing the marking agent.

It is desirable that ball 10 be treated with the encapsulated marking agent at the time of manufacture. However, an encapsulated marking agent may be applied to a conventional ball by the consumer using an "aftermarket" product. For example, the microcapsules may be suspended within a liquid in which they are non-soluble. The consumer then simply immerses a conventional ball within the liquid and allows it to dry. The liquid is formulated as an adhesive so that the microcapsules adhere to the felt 16. Alternatively, a suspension of microcapsules may be supplied to the consumer as a spray-on product. It should be noted that these "aftermarket" products may be used by the consumer not only to treat conventional balls, but also to replenish the supply of microcapsules on balls that have already been treated by the manufacturer.

Although the present invention has been described primarily in the context of a tennis ball, it may also be embodied in other forms. For example, a marking agent may be applied to other types of sport balls used in court games. Furthermore, the marking agent of the present invention is useful for other applications where it is desired to ascertain the point of contact between two objects. For example, a suspension of microcapsules may be sprayed or otherwise applied to the surface of a golf club or baseball bat as a means for evaluating and improving a player's swing.

As discussed above, it is desirable in most applications for the marking agent to leave only a temporary mark. However, the invention is not limited in this regard as certain applications may require a more durable mark. In some applications, it may be desirable for the ability to mark to be only temporary. In such cases, the microcapsules may be prepared so as to disintegrate or otherwise spontaneously release the marking agent after some predetermined period of exposure to air. Upon disintegration of the microcapsules, the marking agent would then also dissipate.

The present invention is useful not only for revealing the point of contact between two objects, but also for indicating the force with which the contact was made. It is possible to quite precisely control the physical characteristics, such as thickness and diameter, of the microcapsules. Thus, the amount of force or pressure required to rupture the microcapsules can also be fairly precisely determined. In this way, the microcapsules can be prepared so that the marking agent is released only if the force of contact exceeds a predetermined threshold. Such a product has utility, for example, in assembly operations. A fastener requiring a particular torque or pressure to be properly secured may be coated with a marking agent encased within a microcapsule designed to rupture at the appropriate torque or pressure, thereby providing a visual indication that the fastener was properly secured. Alternatively, the marking agent could be applied to the tool, such as a torque wrench, used to secure the fastener.

Microencapsulated marking agents may be used to quantitatively indicate a force of contact. Different colored marking agents may be encapsulated in microcapsules designed to rupture at a sequence of different force levels. For example, a red marking agent may be used in microcapsules designed to rupture at five pounds of force, a yellow marking agent may be used in microcapsules designed to rupture at ten pounds and a blue marking agent may be used in microcapsules designed to rupture at fifteen pounds. An object is then coated with a mixture of these various microcapsules. If the object contacts another object with a force of less than five pounds, no marking agent is released. Between five pounds and ten pounds, only red marking agent is released. Between ten pounds and fifteen pounds, both red and yellow marking agents are released, providing a visual indication with the color orange. Above fifteen pounds, the blue marking agent is also released, providing a brown or purple indication.

It will be recognized that the above-described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. A method of treating a tennis ball to reveal a contact location comprising:

encapsulating a marking agent in microcapsules, the marking agent leaving a temporarily visible mark when released from the microcapsules;

coating the microcapsules with an adhesive activated by one of heat or radiation;

applying the microcapsules to a felted outer surface of a tennis ball;

activating the adhesive to adhere the microcapsules to the felted outer surface of the tennis ball.

2. The method of claim 1 wherein the marking agent is a volatile solid.

3. The method of claim 1 wherein the marking agent is a volatile liquid.

4. The method of claim 1 wherein the microcapsules rupture above a predetermined force threshold.

* * * * *